US009498069B2

(12) United States Patent
Derowitsch et al.

(10) Patent No.: US 9,498,069 B2
(45) Date of Patent: Nov. 22, 2016

(54) MATTRESS MANUFACTURING PROCESS AND APPARATUS

(71) Applicant: DREAMWELL, LTD., Las Vegas, NV (US)

(72) Inventors: Timothy S. Derowitsch, Janesville, WI (US); Eric S. Reese, Janesville, WI (US)

(73) Assignee: DREAMWELL, LTD., Las Vegas, NV (US)

( * ) Notice: Subject to any disclaimer, the term of this patent is extended or adjusted under 35 U.S.C. 154(b) by 173 days.

(21) Appl. No.: 14/537,056

(22) Filed: Nov. 10, 2014

(65) Prior Publication Data

US 2016/0130132 A1 May 12, 2016

(51) Int. Cl.

| | |
|---|---|
| ***B68G 7/06*** | (2006.01) |
| ***A47C 27/15*** | (2006.01) |
| ***B68G 15/00*** | (2006.01) |
| *B68G 7/05* | (2006.01) |
| *A47C 27/20* | (2006.01) |

(52) U.S. Cl.

CPC ..... *A47C 27/15* (2013.01); *B68G 7/06* (2013.01); *B68G 15/005* (2013.01); *A47C 27/20* (2013.01); *B68G 7/051* (2013.01)

(58) Field of Classification Search

CPC ..... B68G 7/06; B68G 7/051; A47C 27/06–27/07; A47C 27/14–27/20

USPC ..... 156/293; 53/524

See application file for complete search history.

(56) References Cited

U.S. PATENT DOCUMENTS

| | | | | |
|---|---|---|---|---|
| 685,160 | A | 10/1901 | Marshall | |
| 4,234,983 | A | 11/1980 | Stumpf | |
| 4,234,984 | A | 11/1980 | Stumpf | |
| 4,439,977 | A | 4/1984 | Stumpf | |
| 4,451,946 | A | 6/1984 | Stumpf | |
| 4,523,344 | A | 6/1985 | Stumpf | |
| 4,578,834 | A | 4/1986 | Stumpf | |
| 5,016,305 | A | 5/1991 | Suenens et al. | |
| 5,621,935 | A | 4/1997 | St. Clair | |
| 2004/0261186 | A1* | 12/2004 | Gladney | A47C 23/00 5/717 |

* cited by examiner

*Primary Examiner* — Carson Gross
(74) *Attorney, Agent, or Firm* — Cantor Colburn LLP

(57) ABSTRACT

A process and apparatus for manufacturing a mattress generally includes an insertion station for supporting an innercore, a movable platform for supporting a bucket, and an adhesive applicator intermediate the insertion station and the movable platform. The adhesive applicator is configured to apply adhesive prior to or simultaneous with insertion of the innercore unit into a cavity of the bucket. The innercore unit is gravity fed from an elevated surface of the insertion station into a leading edge of the bucket cavity to form the innercore unit and bucket assembly. The process and apparatus minimizes and/or eliminates manual labor as it relates to the manufacture of the innercore unit and bucket assembly.

9 Claims, 6 Drawing Sheets

MATTRESS MANUFACTURING PROCESS AND APPARATUS

BACKGROUND

The present disclosure generally relates to mattress manufacture, and more particularly, to a glue and insertion process for securing an innercore unit to a bucket assembly.

In conventional mattress manufacturing, an innercore unit is oftentimes inserted into a foam-based bucket assembly during construction of the mattress. Current processes for manufacturing the mattress include numerous steps utilizing manual labor including the assembly of the innercore unit and bucket. For example, as shown in prior art FIG. 1, a typical process flow 10 for gluing and inserting an innercore unit to the bucket generally includes two operators physically lifting the innercore unit as shown in step 12 and employing a throwing action to insert the innercore unit into the cavity defined by the bucket as shown in step 14. The innercore unit, which is typically a rectangularly shaped layer of spring coils and/or foam dimensioned to fit within the cavity, is thrown because of its inherent flexibility, bulk size, and weight. These properties cause the innercore unit to collapse upon itself when lifted at about a midpoint along the length of the innercore unit. Once the innercore unit is thrown into the cavity defined by the bucket, one half end of the innercore unit is lifted by both operators on opposing sides to permit one or both operators to apply an adhesive into the cavity so as to adhesively affix that particular half end of the innercore unit to the bucket as shown in step 16. The operators then repeat the process for the other half end of the innercore unit so that the entirety of the innercore unit is affixed to at least a platform base layer of the bucket as shown in step 18.

Not surprisingly, the above process has inherent variability as these particular steps are operator driven. Application of the adhesive itself can vary across the surface since the amounts are not regulated leading to frequent instances of inadequate adhesive as well as excessive application. Inadequate glue as well as variability across the surface can lead to failures, which directly affect quality. Excessive adhesive application, translates directly to increased costs.

BRIEF SUMMARY

Disclosed herein are processes and apparatuses for manufacturing a mattress including, in particular, the process of assembling an innercore unit and bucket assembly. In one embodiment, the process includes automatically applying an adhesive from a static position onto a selected surface of a moving bucket, wherein the bucket comprises a base layer and a side rail assembly attached to the base layer and disposed about a periphery thereof to define a cavity; and inserting an innercore unit into the cavity at a leading edge thereof from an elevated support surface positioned above the bucket, wherein inserting the innercore unit is gravity assisted, and wherein the innercore unit contacts the adhesive on the selected surface when fully inserted into the cavity to form the innercore unit and bucket assembly.

The apparatus includes an insertion station having an elevated surface for supporting an innercore unit; a movable platform comprising a movable cart having a surface configured to support a bucket, wherein the bucket comprises a base layer and a side rail assembly attached to the base layer and disposed about a periphery thereof to define a cavity, and wherein the movable cart is configured to movably position the bucket underneath the insertion station to a predetermined position so that a leading edge of the innercore unit is generally aligned with and is configured to be gravity fed into the cavity at a leading edge thereof; and an adhesive applicator statically disposed intermediate the insertion station and the movable platform when at the predetermined position, wherein the adhesive applicator is configured to apply adhesive to a selected surface of the bucket prior to or simultaneous with the insertion of the innercore unit into the cavity.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

Prior Art

DETAILED DESCRIPTION

Disclosed herein is an adhesive and insertion station and process for manufacturing a portion of a mattress that overcomes the above noted problems in the prior art. The process generally includes application of a controlled volume of the adhesive to desired surfaces within the bucket in a desired pattern in combination with a gravity fed innercore unit step for insertion into a cavity defined by the bucket. Optionally, the process can be integrated with a programmable logic control system to further minimize and/or eliminate direct operator manipulation. Advantageously, the adhesive and insertion process eliminates inadequate and/or excessive adhesive being applied to the cavity surfaces during manufacture. Moreover, minimal manual labor and effort is needed to insert the innercore unit into the bucket to form the assembly and/or apply the adhesive to selected bucket surfaces prior to insertion of the innercore unit.

The mattress itself is not intended to be limited and may be of any type, dimension, and/or shape. For example, the mattress may be a foam mattress, a coiled mattress, a foam and coil mattress, an air mattress, combinations thereof, or the like. Typically, the mattress is square or rectangular-shaped and has a thickness ranging from about 4 inches to about 20 inches. The length and width can vary depending on the intended application and typically has a width of about 2 feet to about 7 feet and a length of about 4 feet to about 10 feet, although custom sizes may require smaller or larger dimensions.

Figure 2:
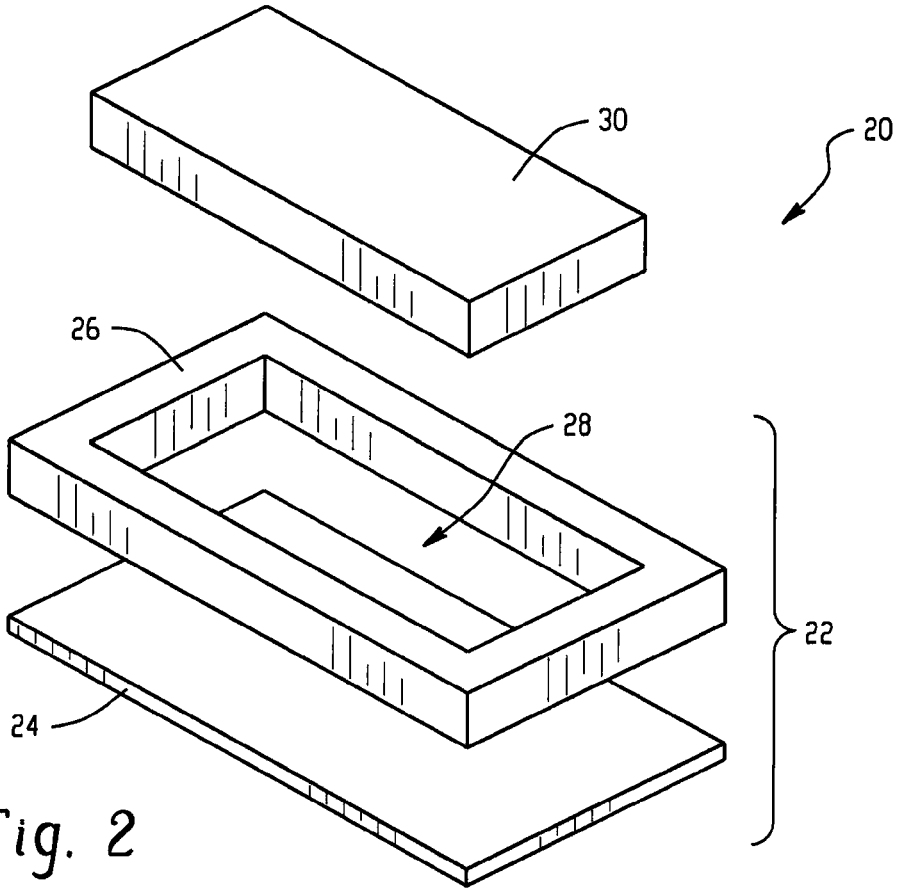
FIG. 2 illustrates an exploded perspective view of an exemplary innercore unit and bucket assembly.

FIG. 2 depicts an exemplary exploded perspective view of an innercore unit and a foam encased bucket assembly generally designated by reference numeral 20 employed in construction of the mattress. The bucket 22 includes a planar base layer 24, also referred to as the platform base layer, typically made of foam and dimensioned to approximate the size of the intended mattress. The base layer 24 may consist of a foam, or it may comprise a wooden, cardboard, or plastic structure selected to provide support to the mattress core. Depending on the mattress core selected and its inherent stiffness, stiffer or more compliant base layers may be chosen. By way of example, the base layer 24 may have a high density polyurethane foam layer (20-170 ILD), or several foam layers (20-170 ILD each), that alone or in combination, provide a density and rigidity suitable for the application. Such a choice, as well as the choice of the means and methods for attaching side walls to platform, are well within the skill of an ordinary practitioner.

A side rail assembly 26, which can be manufactured as a single piece or as multiple pieces, is affixed about the perimeter of the planar base layer 24. The side rail assembly 26 is typically constructed from a dense natural and/or synthetic foam material of the type commonly used in the bedding arts. The foam may be (but is not limited to) latex, polyurethane, or other foam products commonly known and used in the bedding and seating arts and having a suitable density. A typical density is about, but not limited to 1.0 to 3.0 and more typically 1.5 to 1.9, and 20 to 60 ILD, and more typically 20 to 35. One example of such a foam is the high density polyurethane foam and is commercially available from the Foamex Corporation in Linwood, Ill. Alternatively, any foam having a relatively high indention load deflection (ILD) would be satisfactory for the manufacture of the side rail assembly. Although a specific foam composition is described, those skilled in the art will realize that foam compositions other than one having this specific density and ILD can be used. For example, foams of various types, densities, and ILDs may be desirable in order to provide a range of comfort parameters to the buyer.

The size of the side rail assembly 26 can vary according to the application, but each rail typically measures 3-10 inches (7.5-25 cm) in thickness. The depicted side rails are equal in width, and their length is chosen to correspond to the length of the size of mattress desired. For a regular king size or Queen size mattress, the length of rails can be about 78.5 inches (200 cm), although the length can vary to accommodate the width of the header or footer, it the header or footer is to extend across the full width of the base platform 102. Similarly, the header/footer piece typically has a thickness of about 3-10 inches (7.7-25 cm), and the width is chosen to correspond to the width of the size of mattress desired. In the case of a regular king size mattress the width would be about 74.5 inches (190 cm), and for a queen size mattress, the width would be about 58.5 inches (149 cm), depending on how the foam rails are arranged to form the perimeter sidewall.

The side rail assembly 26 can be mounted or attached to base layer 24 by conventional means, such as (but not limited to) gluing, stapling, heat fusion or welding, or stitching.

The bucket assembly 22 comprised of the base layer 24 and side rail assembly 26 as constructed defines a well or cavity 28. The well or cavity 28 provides a space in which an innercore unit 30 can be inserted. When the components defining the bucket are formed of foam, the bucket is commonly referred to as a foam encased bucket.

The innercore unit 30 may be comprised of conventional helical or semi-helical coil springs known and used in the art today. The coil springs may also be encased in a fabric material, either individually in pockets, in groups, or in strings joined by fabric, all of which are well-known in the bedding art. For many years, one form of spring assembly construction has been known as Marshall construction. In Marshall construction, individual wire coils are each encapsulated in fabric pockets and attached together in strings which are arranged to form a closely packed array of coils in the general size of the mattress. Examples of such construction are disclosed in U.S. Pat. Nos. 685,160, 4,234,983, 4,234,984, 4,439,977, 4,451,946, 4,523,344, 4,578,834, 5,016,305 and 5,621,935, the disclosures of which are incorporated herein by reference in their entireties.

Alternatively, a foam core module may also be utilized as the innercore unit 30. The foam core module is, in some embodiments, a monolithic block of a single type of resilient foam selected from foams having a range of densities (themselves well-known in the art) for supporting one or more occupants during sleep. In one embodiment, foam core is made of any industry-standard natural and/or synthetic foams, such as (but not limited to) latex, polyurethane, or other foam products commonly known and used in the bedding and seating arts having a density of 1.5 to 1.9 and 20 to 35 ILD. Although a specific foam composition is described, those skilled in the art will realize that foam compositions other than one having this specific density and ILD can be used. For example, foams of various types, densities, and ILDs may be desirable in order to provide a range of comfort parameters to the buyer.

In an alternative embodiment, the foam innercore unit may comprise one or more horizontal layers of multiple types of foams arranged in a sandwich arrangement. This sandwich of different foams, laminated together, may be substituted for a homogeneous foam block of a single density and/or ILD.

In a further embodiment, the foam innercore unit may comprise one or more vertical regions of different foam compositions (including vertical regions having multiple horizontal layers), where the different foams are arranged to provide different amounts of support (also referred to as "firmness" in the art) in different regions of the sleeping surface.

Accordingly, the present disclosure is not limited to any particular type of foam density or ILD or even to a homogenous density/ILD throughout the foam core. Moreover, it should be apparent that the innercore unit 22 can be a combination of foam and coils.

The innercore unit is typically covered with padding layers on the top and bottom surfaces, and the whole assembly is encased within a ticking, often quilted, that is sewn closed around its periphery to a border or boxing. After assembly the mattress can be covered by any other decorative covering or pillow-top.

Figure 3:
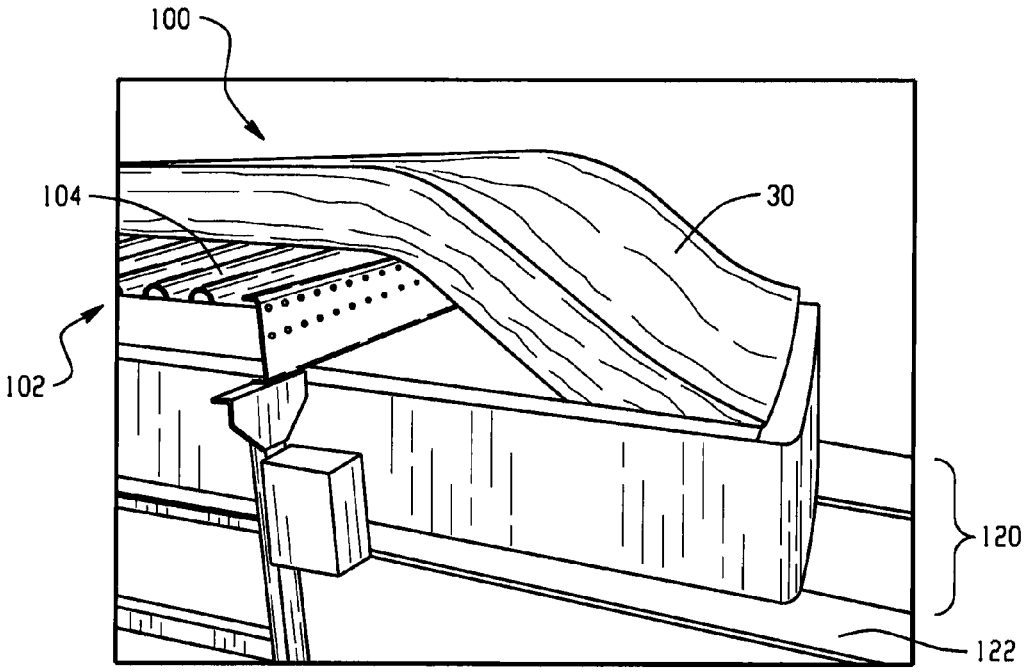
FIG. 3 is a pictorial view depicting a gravity assist step for inserting the innercore unit into the bucket during manufacture of the innercore unit and bucket assembly in accordance with an embodiment of the present disclosure.

Referring now to FIG. 3, the apparatus 100 for the glue and insertion process generally includes an innercore unit insertion station 102 for positioning the innercore unit 30 into the cavity 28 of the bucket 22 via gravity and a movable platform 120 for moving the bucket into a position to receive the innercore unit. The insertion station 102 can include an elevated support surface 104 relative to ground and the movable platform 120 upon which the innercore unit 30 is supported and first positioned for subsequent insertion. The support surface 104 can optionally include a plurality of rollers as shown and/or a belt to minimize forces required to position the innercore unit 30 for insertion into the bucket 22 when assembling the innercore unit and bucket assembly. The elevated support surface 104 is dimensioned to approximate and/or support the innercore unit and has sufficient clearance underneath to accommodate the movable platform 120 with the bucket assembly 22 thereon during operation. The insertion station 102 may further include an insertion tongue, which is an angled surface that functions to guide the innercore unit into the bucket cavity during operation.

Figure 4:
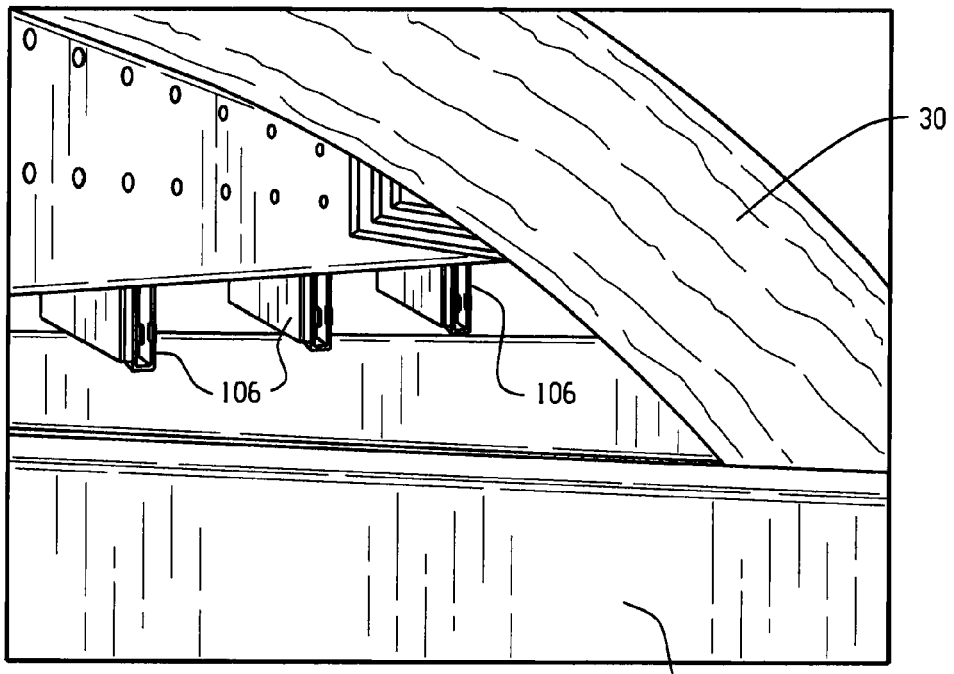
FIG. 4 is also a pictorial view depicting a gravity assist step for inserting the innercore unit into the bucket during manufacture of the innercore unit and bucket assembly in accordance with an embodiment of the present disclosure.

As shown more clearly in FIG. 4, the insertion station 102 can include a statically positioned adhesive applicator 106 positioned underneath the insertion station 102 and configured to apply adhesive to selected surfaces of the bucket when the movable platform 120 is positioned underneath the insertion station as will be described in greater detail below. The adhesive applicator 106 may be mounted directly to the insertion station as shown or may be a separate unit as may be desired for different applications. The adhesive applicator 106 is configured to provide a controlled amount of adhesive to the desired surfaces in the cavity of the bucket in whatever pattern as may be desired. The application of the adhesive may be intermittent or continuous. Similarly, the adhesive applied may be applied to all of the surfaces defining the cavity or to selected surfaces as may be desired in some applications. In one embodiment, the adhesive applicator 106 includes a plurality of nozzles in fluid communication with a source of adhesive. The adhesive applicator may be coupled to a motion detector system for actuating the nozzles when the movable platform and the bucket are in position. In one embodiment, the adhesive applicator is a dual pump spray system that provides a metered volume and the nozzles therein are configured to provide a desired pattern of a hot melt adhesive through the use of a programmable logic control device. Actuation of the adhesive applicator can be configured to occur upon detection by the motion detector system of the leading edge of the bucket assembly traveling underneath the insertion station and discontinued upon detection of the trailing edge of the bucket. The static position of the adhesive applicator provides controlled adhesive application and patterning, thereby allowing for consistent and repeatable application of the adhesive.

Figure 1:
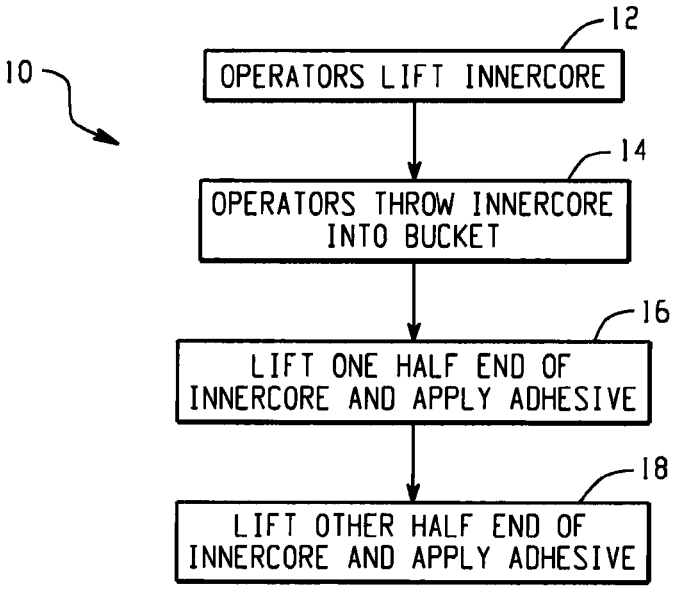
Fig. 1 PRIOR ART
FIG. 1 depicts a conventional process flow for manufacture of the innercore unit and bucket assembly.
Figure 5:
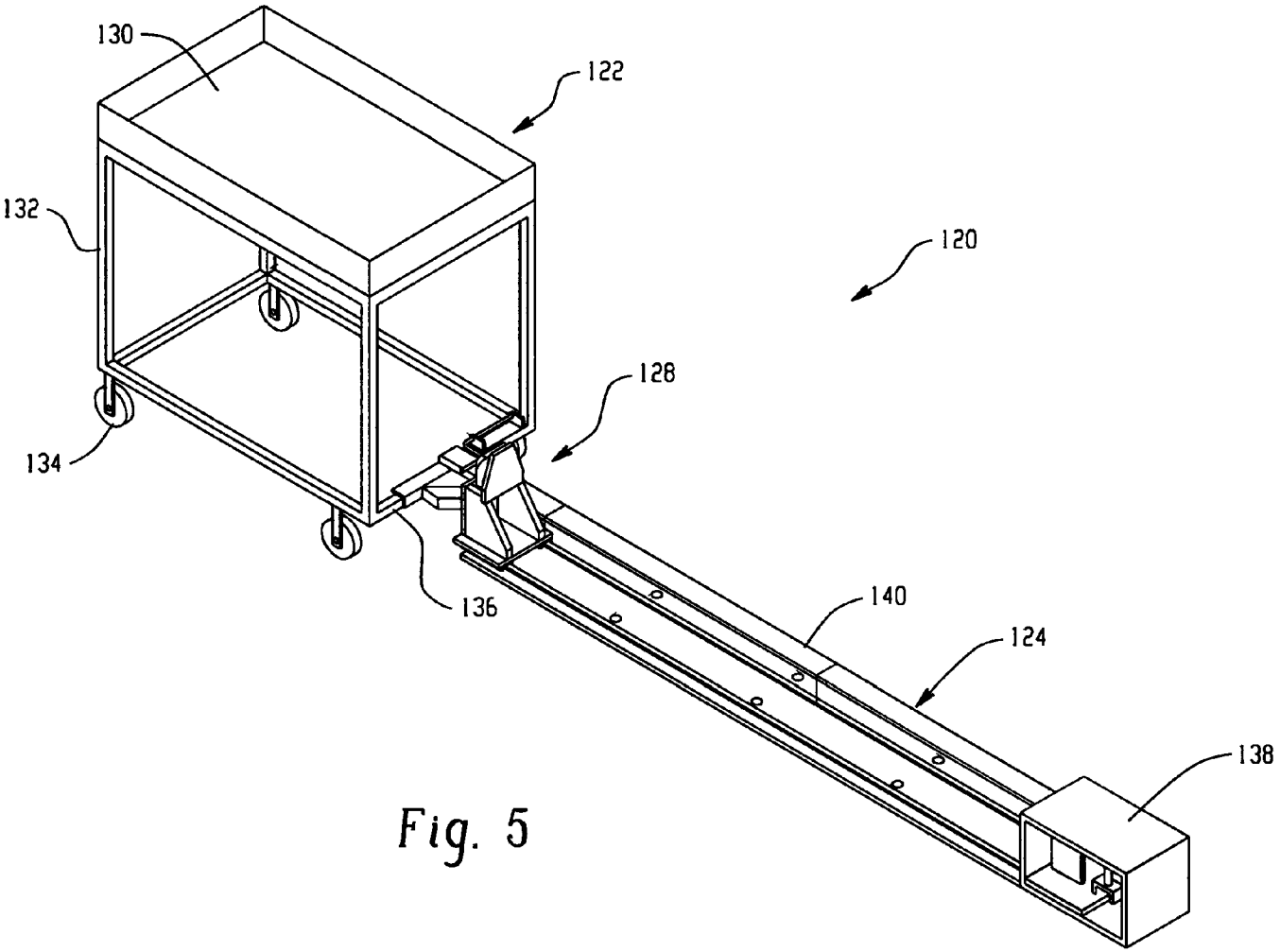
FIG. 5 depicts a perspective view of a movable platform assembly in accordance with an embodiment of the present disclosure.
Figure 6:
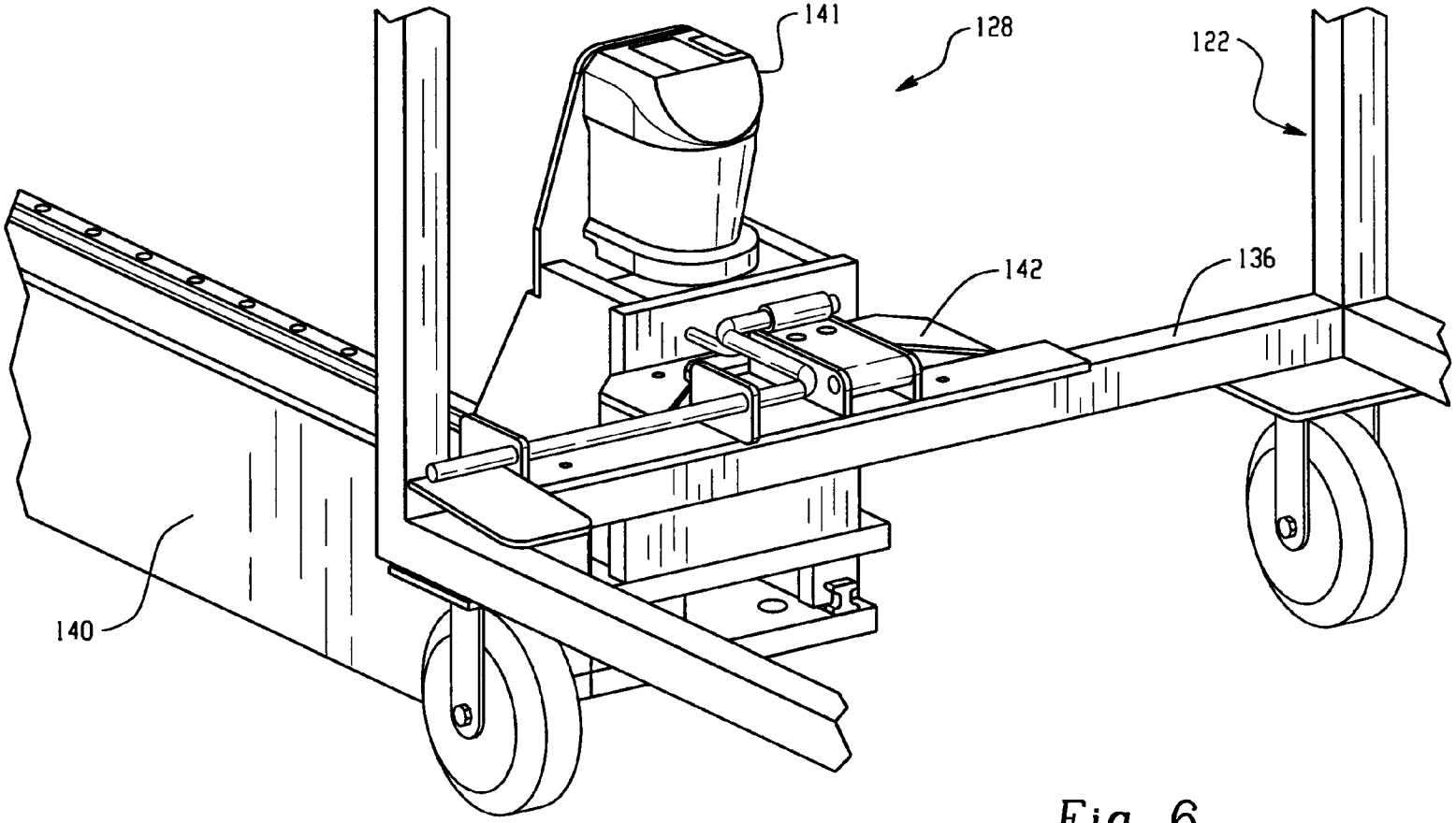
FIG. 6 depicts enlarged partial perspective views of an exemplary coupling device for the movable platform assembly of FIG. 5 in accordance with an embodiment of the present disclosure.
Figure 7:
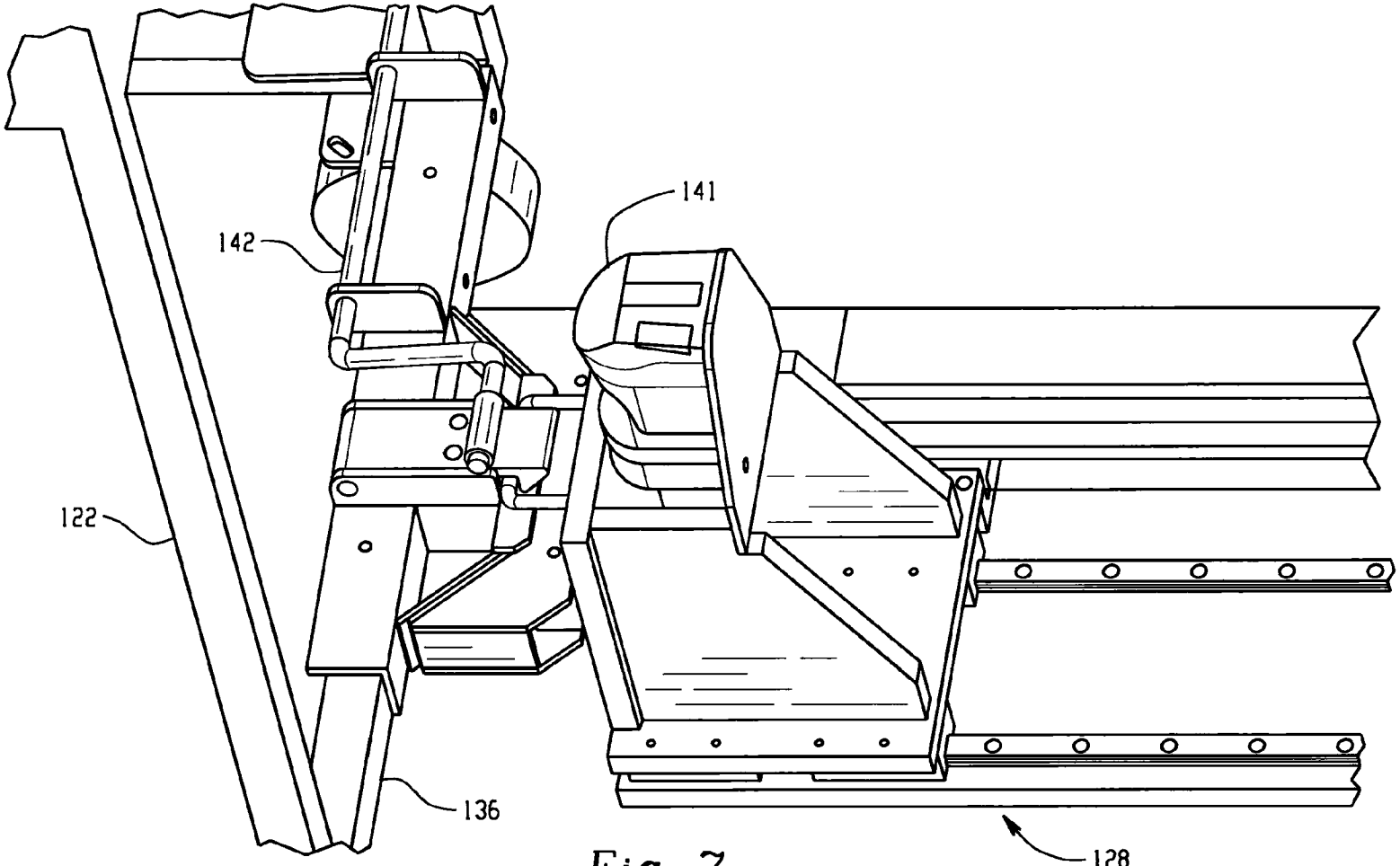
FIG. 7 also depicts enlarged partial perspective views of an exemplary coupling device for the movable platform assembly of FIG. 5 in accordance with an embodiment of the present disclosure

The movable platform assembly 120 is shown more clearly in FIGS. 5-7 and is utilized to position the bucket 22 to a predefined position underneath the insertion station 102 so that a leading edge of the innercore unit can be inserted into the bucket using a gravity assist actuation and the adhesive applicator is positioned at a leading edge of the cavity. An operator and/or an automated assist can be used to guide the innercore unit into the cavity of the bucket. Gravity assist of the innercore unit into the cavity is shown by directional arrow 130. The gravity assisted insertion of the innercore unit into the bucket to form the assembly eliminates the need for operator pulling, twisting, lifting, shoving and the like that was commonly employed in the prior art processes (see prior art FIG. 1).

The movable platform assembly 120 generally includes a movable cart 122 mechanically and releasably engageable with a guide rail 124. The movable cart 122 generally includes a surface 130 for receiving the bucket for use in the adhesive application and innercore unit insertion process, one or more supports 132 for supporting the surface 130, an engageable member 136 that can be releasably engaged with the coupling device 124 and one or more movable casters 134, four of which are shown. The surface may define a cavity into which the bucket is disposed during processing. The movable cart 122 is not limited to use in the adhesive application and insertion process and can be detached from the movable platform assembly and utilized for other manufacturing processes as may be desired when the movable platform assembly is not in use or for retrieving a bucket for use in the innercore unit and bucket assembly process.

The guide rail 124 includes a track 126 and a coupling device 128 movably positioned on the track. The track is as shown is configured to provide a linear pathway but may be configured to provide an arcuate pathway as may be desired. The track includes a motor drive mechanism 138 at one end for controlling both forward and reverse directions of the movable cart 122 that can be controlled via a programmable logic control, which may include a variable speed drive to regulate speed. The motor drive mechanism 138 is in operative communication with a belt (not shown) disposed within a casing 140. The coupling device 128 is operatively coupled to the belt (not shown) to effect movement of the coupling device 128 when in use. Adjustment to the speed of the movable platform allows for tailored feed rates to pair the adhesive application with innercore insertion, thereby providing reproducible adhesive volume application in the desired pattern.

Figure 8:
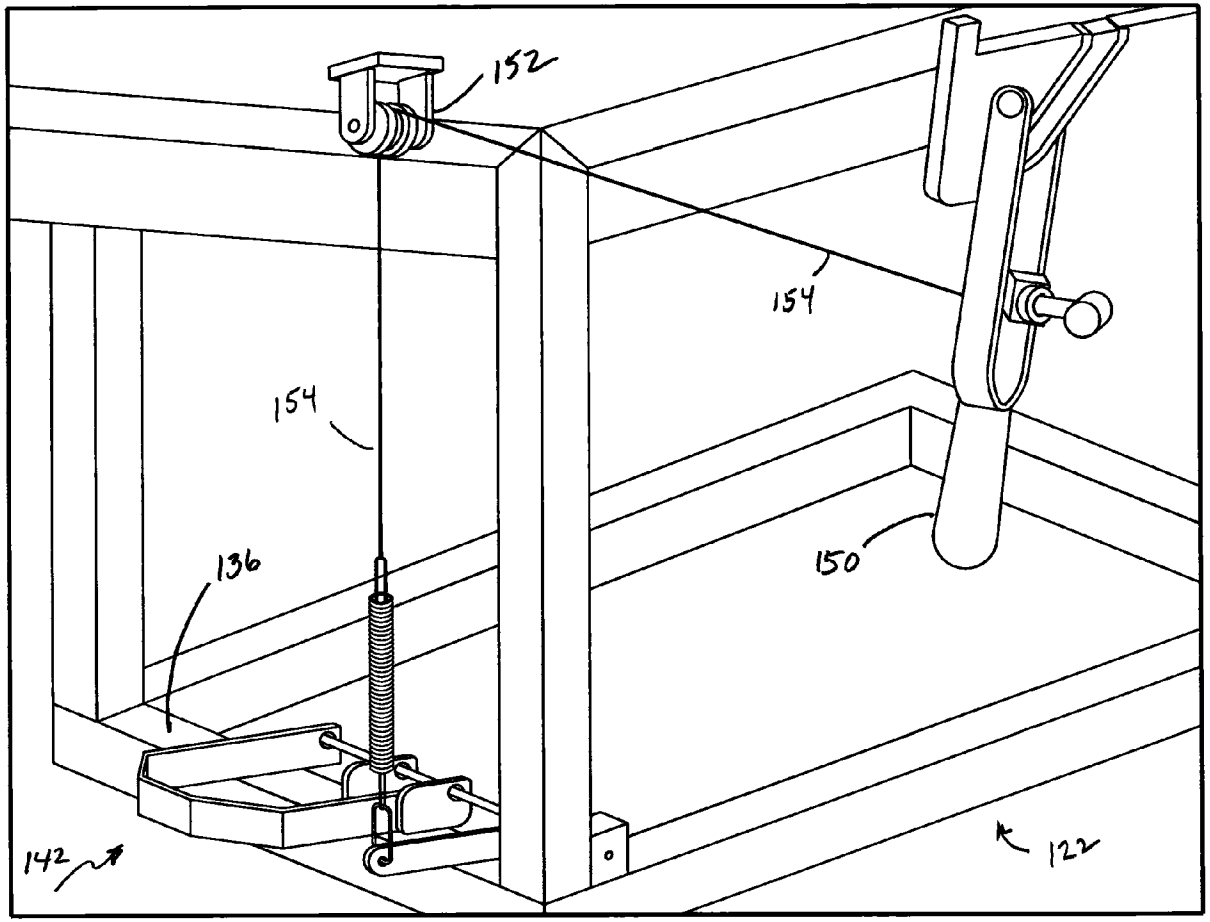
FIG. 8 depicts an enlarged partial perspective view of a coupling device for the movable platform assembly of FIG. 5 in accordance with another embodiment of the present disclosure.

The coupling device 128 includes a sensor 141 for detecting the engageable member 136 of the movable cart 122 and a clamp 142 for engaging and disengaging the movable cart. Engagement may be manual or automated. For example, the clamp may be configured to be releasably engaged via a foot pedal that pivotably moves the clamp onto the engageable member 136 so as to effect engagement. Alternatively, the underside of the movable cart surface 130 may be configured with a hand lever 150 and pulley 152 arrangement that is mounted underneath a support surface of the movable cart 122, wherein the hand lever 150 is operatively coupled to the clamp 142 via a spring loaded cable 154 to effect releasable engagement of the coupling device to the movable cart 122 as shown in FIG. 8. The hand lever lifts the clamp 142 from the engageable member 136 to effect release. The releaseable coupling of the coupling device to the movable cart is not intended to be limited.

During operation, once the innercore unit is at the predetermined position on surface 104 of the insertion station 102, the operator will press a "start" button which will allow the innercore unit to move off of the surface 104 and down the insertion tongue, if present. The leading edge of the innercore unit will be guided into the leading edge of the bucket, which is carried by the surface such that as the movable cart moves away from the insertion station the remainder of the innercore unit will be gravity fed into the bucket cavity. The movable cart is positioned underneath adhesive applicator such that as the movable cart moves away from the insertion station, adhesive is applied onto selected surfaces of the bucket and prior to or simultaneous with insertion of the innercore unit.

In the event an obstacle interferes with the travel path of the moveable platform, the moveable platform may further include forward and reverse facing photodetectors configured to detect the obstacle and discontinue movement of the platform and adhesive application. During operation, the movable cart 122 travels at least partially underneath the insertion table and is positioned to accommodate the gravity insertion of the innercore unit. During adhesive application, the movable platform continues movement as is generally shown by arrow 132 until the innercore in its entirety is disposed within the cavity. In this manner, adhesive can be applied prior to and/or simultaneous with insertion of the innercore into the cavity.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A process for manufacturing an innercore unit and bucket assembly, comprising:

automatically applying an adhesive from a static position onto a selected surface of a moving bucket, wherein the bucket comprises a base layer and a side rail assembly attached to the base layer and disposed about a periphery thereof to define a bucket cavity; and inserting an innercore unit into the bucket cavity at a leading edge thereof from an elevated support surface positioned above the bucket, wherein inserting the innercore unit is gravity assisted, and wherein the innercore unit contacts the adhesive on the selected surface when fully inserted into the cavity to form the innercore unit and bucket assembly.

2. The process of claim 1, wherein applying the adhesive comprises spraying a pattern of the adhesive onto the surface.

3. The process of claim 1, wherein the adhesive comprises a hot melt adhesive.

4. The process of claim 1, wherein applying the adhesive is prior to inserting the innercore unit into the bucket cavity.

5. The process of claim 1, wherein applying the adhesive is simultaneous with inserting the innercore unit into the bucket cavity.

6. The process of claim 1, wherein applying the adhesive is metered.

7. The process of claim 1, wherein the innercore unit comprises coil springs and/or foam.

8. The process of claim 1, wherein applying the adhesive onto the selected surface of the bucket comprises moving the bucket on a movable platform to position the leading edge of the cavity to be underneath an adhesive applicator configured for applying the adhesive.

9. The process of claim 1, wherein inserting the innercore unit into the bucket cavity to form the innercore unit and bucket assembly comprises moving a leading edge of the innercore unit from the elevated support surface and inserting the leading edge of the innercore unit onto the leading edge of the cavity, wherein gravity assists in inserting a remainder of the innercore unit into the cavity to form the innercore unit and bucket assembly.

* * * * *